US008641348B2

(12) United States Patent
Kojima et al.

(10) Patent No.: US 8,641,348 B2
(45) Date of Patent: Feb. 4, 2014

(54) APPARATUS FOR FORMING HARDBACK BOOK COVER

(75) Inventors: Nobuyuki Kojima, Shiga (JP); Ko Ouchiyama, Shiga (JP); Kazuyuki Fukushima, Shiga (JP)

(73) Assignee: Horizon International Inc., Shiga (JP)

( * ) Notice: Subject to any disclaimer, the term of this patent is extended or adjusted under 35 U.S.C. 154(b) by 638 days.

(21) Appl. No.: 12/464,260

(22) Filed: May 12, 2009

(65) Prior Publication Data

US 2009/0285656 A1 Nov. 19, 2009

(30) Foreign Application Priority Data

May 14, 2008 (JP) ..... 2008-126679

(51) Int. Cl.
*B42C 7/00* (2006.01)

(52) U.S. Cl.
USPC ..... 413/17; 413/3

(58) Field of Classification Search
USPC ..... 412/3, 17
See application file for complete search history.

(56) References Cited

U.S. PATENT DOCUMENTS

| | | | | |
|---|---|---|---|---|
| 5,203,590 | A | 4/1993 | Ranson | |
| 2005/0180843 | A1* | 8/2005 | Porat | 412/19 |
| 2008/0054619 | A1 | 3/2008 | Barth | |

FOREIGN PATENT DOCUMENTS

| | | |
|---|---|---|
| JP | 2002-019329 | 1/2002 |
| JP | 2003-159883 | 6/2003 |
| WO | WO/02/45923 A1 | 6/2002 |

* cited by examiner

*Primary Examiner* — Dana Ross
*Assistant Examiner* — Matthew G Katcoff
(74) *Attorney, Agent, or Firm* — Kirschstein, et al.

(57) ABSTRACT

A table (31) is located in a first position and a second position which is rotated at 90 degrees from the first position. A cover (27) is arranged on a top face of the table (31) and fixed to the table (31) by fixing means (32*a*, 32*b*). Cardboards are preliminarily attached to predetermined positions on a rear face of the cover (27), and an outer margin of a predetermined width is formed outside the cardboard. Folding units (35) are arranged on either side of the table (31), and guided by guide rails (34) for reciprocal linear movement in directions toward and away from the table (31). The folding units (35) are located in an outer margin folding position at which said folding units (35) engage with the cover (27) on the table (31) and fold the outer margin of the cover (27) so as to attach the outer margin to the cardboards, and a standby position at which the folding units (35) separate from the cover (27). A control unit controls the table (31) and the folding units (35). The folding units (35) are synchronized with each other in such a manner that the folding units (35) simultaneously fold the outer margin of the cover (27) each time the table (31) is located in the first and second positions.

9 Claims, 16 Drawing Sheets

*PRIOR ART*

APPARATUS FOR FORMING HARDBACK BOOK COVER

BACKGROUND OF THE INVENTION

1. Field of the Invention

The present invention relates to an apparatus for forming a hardback book cover (a rigid cover) in hardback bookbinding, especially, in simple hardback bookbinding in which a hardback book is bounded by adhesive binding.

2. Description of the Related Art

A conventional hardback book is manufactured as a casebound book by attaching a rigid cover after applying a thread stitching to the spine of a book block, however, recently, the hardback book is also manufactured by attaching a rigid cover to the book block whose spine is preliminarily bounded by adhesive.

FIG. 16 is an exploded perspective view of a hardback book manufactured by a simple hardback bookbinding. Referring to FIG. 16, the hardback book is composed of a book block 50 whose spine is preliminarily bounded by adhesive, and a rigid cover 51 attached to the spine of the book block 50. The rigid cover 51 is composed of a cover 52 having a cardboard stiffener. In this case, a first cardboard 53 forming a front book cover, a second cardboard 54 forming a back book cover, and a third cardboard 55 forming the spine are attached to predetermined positions on the rear face of the cover 52, and an outer margin of a predetermined width is formed outside the cardboards 53 to 55 (a region forming top and bottom edges of the hardback book cover and a region forming front and back edges of the hardback book cover). Further, the outer margin is folded and attached to the cardboards 53 to 55, thereby the rigid cover 51 is formed.

Fold lines 52*a* and 52*b* are formed respectively between the first cardboard 53 and the third cardboard 55, and between the second cardboard 54 and the third cardboard 55. The third cardboard 55 is attached to the spine of the book block 50, the first cardboard 53 is attached to a front side end leaf paper 50*a* of the book block 50, and the second cardboard 54 is attached to a rear side end leaf paper 50*b* of the book block 50, so that the hardback book is manufactured.

In the case of forming the hardback book cover as mentioned above, it is necessary to fold the outer margins of four sides of the cover so as to attach them to the cardboards. However, since this work is carried out per one side of the cover by using a single folding unit, it takes a long working hour, and there is a problem that an efficiency is poor.

In addition, in the case of forming a hardback book cover whose corners are cut at 45 degrees, an additional work of folding edges for forming the cut corners is required, and there arises a problem of taking a long time to work.

SUMMARY OF THE INVENTION

Accordingly, an object of the present invention is to provide an apparatus capable of easily forming a hardback book cover in a simple hardcover bookbinding.

In order to achieve the object, according to the present invention, there is provided an apparatus for forming a hardback book cover comprising: a frame; and a table provided with a rotating shaft which extends downward from the underside of the table, and attached to the frame for rotating around the rotating shaft so as to be located in at least two positions of a first position and a second position which is rotated at 90 degrees from the first position in a clockwise or counterclockwise direction. A cover is arranged on the table in such a manner that the center of the cover is aligned with the rotating shaft (31*a*). A first cardboard forming a spine, a second cardboard forming a front cover and a third cardboard forming a rear cover are preliminarily attached to the predetermined positions on the rear face of the cover. The cover has an outer margin of a predetermined width outside each of the cardboards, and the outer margin has an adhesive layer. The apparatus further comprises a fixing means attached to the frame or the table for fixing the cover to the table so as to rotate the cover together with the table; a motor attached to the frame for driving the rotating shaft of the table; guide rails attached to the frame, and linearly extending on either side of the table; and a pair of folding units arranged on either side of the table and guided by the guide rails for reciprocal linear movement in directions toward and away from the table in such a manner that the folding units are located in two positions of an outer margin folding position at which the folding units engage with the cover on the table for folding the outer margin so as to attach the outer margin to the associated cardboards, and a standby position at which the folding units separate from the cover. The cover on the table is arranged to face a pair of opposite sides thereof toward the associated folding units when the table is located in the first position. The apparatus further comprises a control section controlling the motor and the folding units. The control section transmits a control signal to the motor and the folding units for synchronization of the folding units in such a manner that the folding units simultaneously fold the outer margin of the cover each time the table is located in the first and second positions.

According to a preferred embodiment of the present invention, the cover faces the rear face thereof toward said table, and a peripheral region of the cover protrudes from the table over a width which is twice or more than the width of the outer margin. The folding unit comprises: a moving body guided by the guide rails for the reciprocal linear movement; a horizontal support plate attached to the moving body and extending perpendicularly to the movement direction of the moving body; and a guide roller attached to the moving body or the support plate and arranged oppositely to the top face of the support plate for rotation around a rotating shaft extending in a longitudinal direction of the support plate. The movement of the moving body effects a movement of both of the support plate and the guide roller on the surface of the cover and the cardboard while the cover and the cardboards are nipped between the support plate and the guide roller, when the folding unit is located in the outer margin folding position. The folding unit further comprises a folding block attached to the moving body and extending in parallel to the support plate. The folding block is arranged at a side of the support plate for reciprocal vertical movement between a top dead center and a bottom dead center, the side of the support plate facing away from the table. The folding unit further comprises a driving unit attached to the moving body for moving the folding block. The folding block has at least a horizontal top face, a lower face and a vertical front face facing to the table. The lower face of the folding block is positioned above the top face of the cover when the folding block is located in the top dead center, and the top face of the folding block is positioned below the top face of the support plate when the folding block is located in the bottom dead center. The control section transmits a control signal to the moving body of the folding unit and the driving unit for interlocking the moving body and the folding block so as to fold an outer margin of the cover when the folding unit is located in the outer margin folding position.

According to another preferred embodiment of the present invention, the folding block is located sequentially in four positions of the top dead center, a first intermediate position at which the front face of the folding block faces to a gap between the support plate and the guide roller, a second intermediate position at which the top face of the folding block is positioned at the same height as the top face of the support plate, and the bottom dead center, when the folding unit is located in the outer margin folding position. The interlocking of the moving body and the folding block comprises: (i) a step of arranging the folding block at the top dead center and moving the moving body toward the table; (ii) a step of stopping the moving body at a first stop position at which the cover and the cardboards are nipped between the support plate and the guide roller, and an edge of the cardboard is positioned between a side of the support plate and the front face of the folding block, the side of the support plate facing away from the table; (iii) a step of moving the folding block downward from the top dead center to the first intermediate position at the first stop position, thereby folding the outer margin of the cover toward the cardboard; (iv) a step of moving the moving body from the first stop position to a second stop position in a direction toward the table until the front face of the folding block comes into contact with an edge of the cardboard, thereby attaching the outer margin to the edge of the cardboard; (v) a step of moving the folding block downward from the first intermediate position to the second intermediate position at the second stop position, and moving the moving body in a direction toward the table from the second stop position to a third stop position at which a front end of the top face of the folding block reaches to at least a leading end of the outer margin, thereby pressing the outer margin against the cardboard by the top face of the folding block so as to attach the outer margin to the cardboard; and (vi) a step of moving the folding block downward from the second intermediate position to the bottom dead position at the third stop position so as to separate the folding block from the cardboard, and moving the moving body in a direction away from the table to a fourth stop position at which the cover and the cardboard get out of the gap between the support plate and the guide roller.

According to still another preferred embodiment of the present invention, the fixing means comprises: a rod attached to the frame, and arranged above the table for reciprocal vertical movement along an extension of the rotating shaft of the table; a second drive unit attached to the frame for actuating the rod; and a pressing plate attached to the lower end of the rod for rotation around the axis of the rod.

According to still another preferred embodiment of the present invention, in the case of forming a hardback book cover whose corners are cut at 45 degrees, corners of the cardboards corresponding to the corners of the hardback book cover are cut at 45 degrees, and the rotating table is adapted for being further located in third and fourth rotating positions which are rotated at 45 degrees from the first position in clockwise and counterclockwise directions, respectively, and the control unit transmits a control signal to the motor and the folding units, and simultaneously folding the outer margin of the cover facing to the folding units by synchronously actuating the folding units when the table is located in the first, second, third and fourth positions.

DETAILED EXPLANATION OF THE PREFERRED EMBODIMENTS

Figure 1:
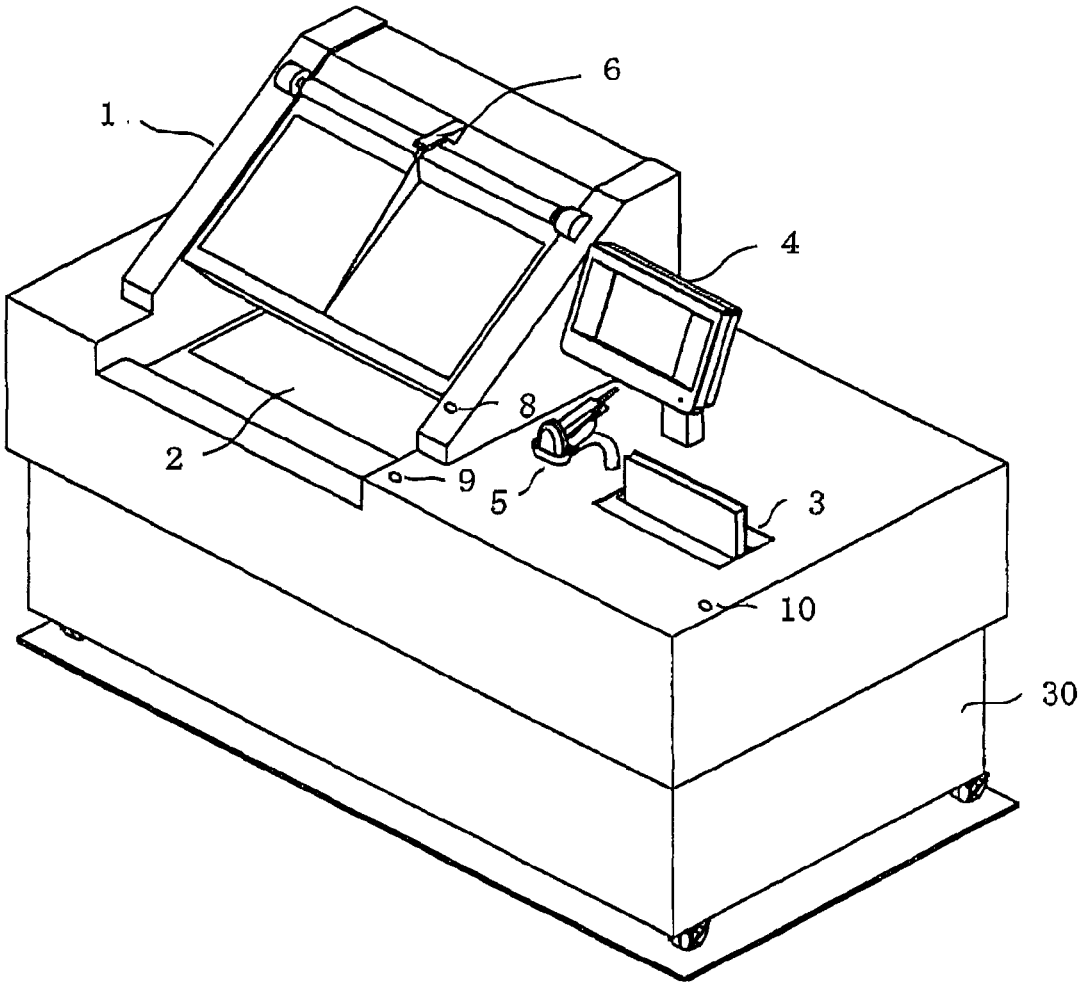
FIG. 1 is a perspective view of a book binding apparatus provided with an apparatus for forming a hardback book cover according to an embodiment of the present invention.
Figure 2:
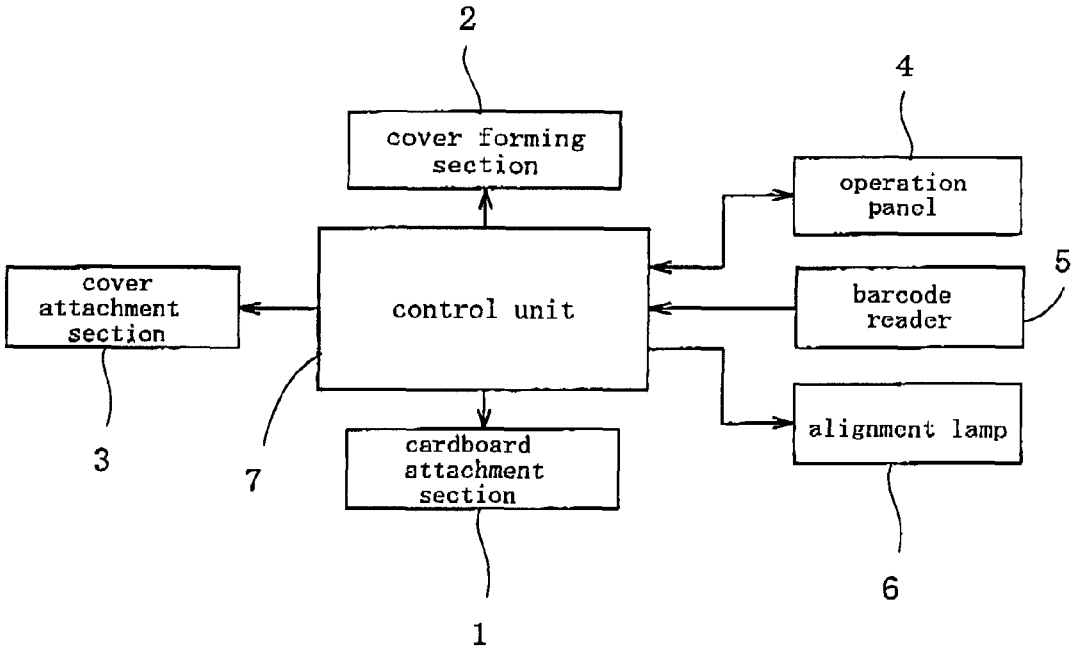
FIG. 2 is a block diagram schematically illustrating a structure of the book binding apparatus shown in FIG. 1.

Preferable embodiments according to the present invention will be described with reference to the accompanying drawings thereinafter. FIG. 1 is a perspective view of a book binding apparatus provided with an apparatus for forming a hardback book cover in accordance with an embodiment of the present invention. FIG. 2 is a block diagram schematically illustrating a structure of the book binding apparatus shown in FIG. 1. Referring to FIGS. 1 and 2, the book binding apparatus has a cardboard attachment section 1 for attaching cardboards, which are employed as a stiffener of a hardback book cover, to a rear face of a cover, a cover forming section 2 folding an outer margin of the cover provided with the cardboards and forming the hardback book cover, and a cover attachment section 3 attaching the hardback book cover (rigid cover) to a book block. Each of the cardboard attachment section 1, the cover forming section 2 and the cover attachment section 3 is controlled by a control section 7, and starts operating by start buttons 8, 9 and 10 being pressed.

The book binding apparatus comprises an operation panel 4 composed of a liquid crystal tough panel, and a barcode reader 5 for checking whether or not a combination of the book block and the hardback book cover is correct, before attaching the hardback book cover to the book block. The control section 7 controls the cardboard attachment section 1, the cover forming section 2 and the cover attachment section 3 in accordance with various data and commands input from the operation panel 4.

Figure 3:
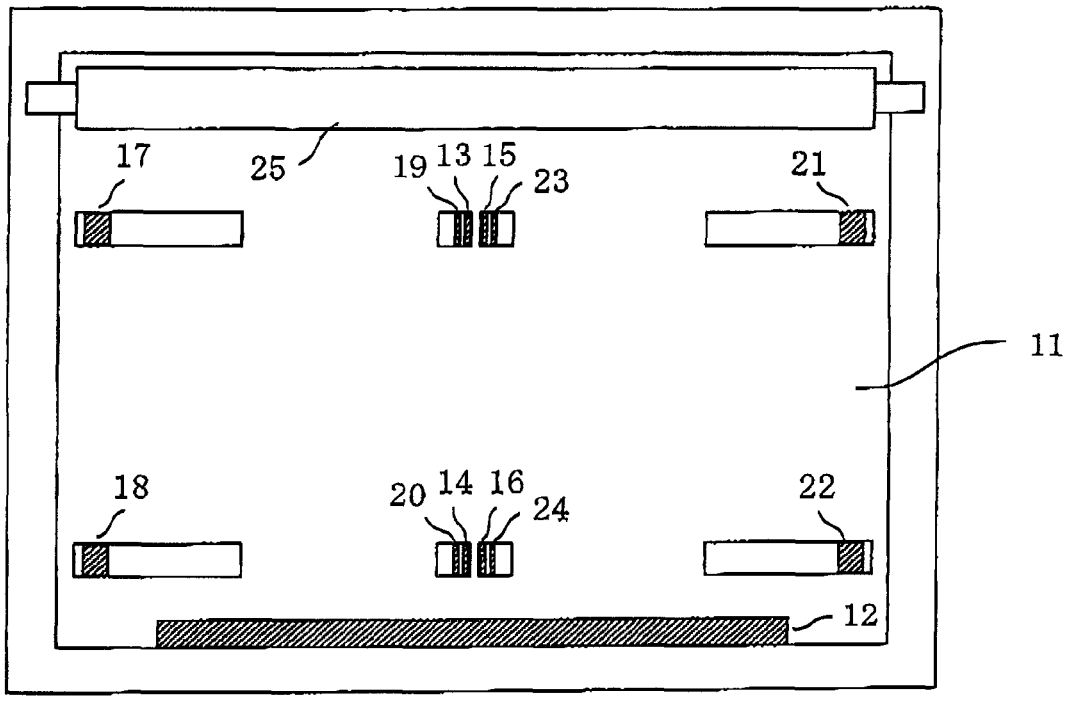
FIG. 3 is a plan view illustrating a structure of a cardboard attachment section of the book binding apparatus.
Figure 4:
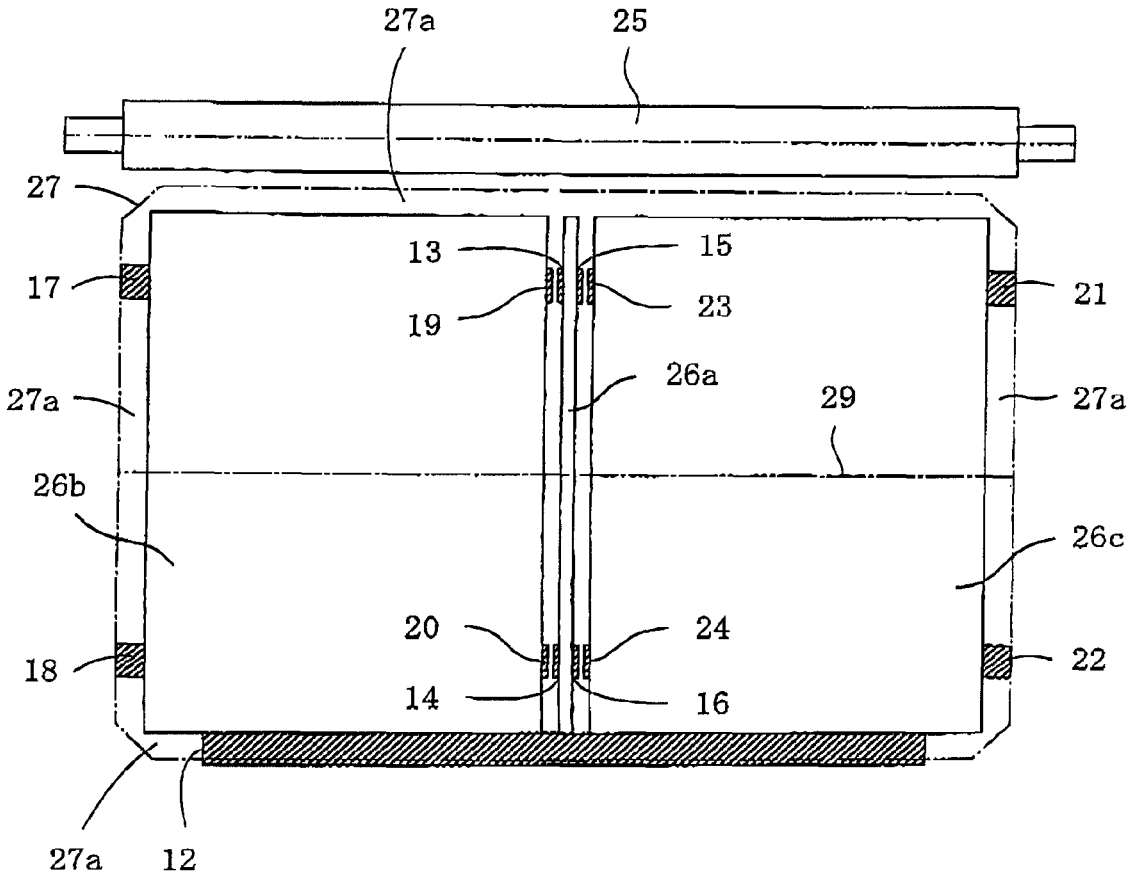
FIG. 4 is a plan view illustrating a cardboard attachment section with cardboards and a cover.

FIG. 3 is a plan view illustrating a structure of the cardboard attachment section 1, and FIG. 4 is a plan view illustrating the cardboard attachment section 1 with cardboards and a cover. Referring to FIGS. 3 and 4, the cardboard attachment section 1 comprises a sloping cardboard application table 11. Cardboards 26*a* to 26*c* employed as a stiffener are arranged at the predetermined positions on the cardboard application table 11, and a cover 27 having an adhesive layer on its rear face is put thereon in such a manner that the rear face of the cover 27 faces to the cardboards 26*a* to 26*c*. In this embodiment, a vertical direction of the cardboard application table 11 corresponds with a direction connecting top and bottom edges of the cover. The cardboard attachment section 1 further comprises an alignment lamp 6 for indicating a center of the cover arranged on the cardboard application table 11 (refer to FIG. 1).

A first guide 12 for positioning lower ends of the cardboards 26*a* to 26*c* is attached to a lower end of the cardboard application table 11. Second guides 13 to 16 for positioning the first cardboard 26*a* which forms the spine, third guides 17 to 20 for positioning the second cardboard 26*b* forming the front cover, and fourth guides 21 to 24 for positioning the third cardboard 26*c* forming the rear cover are attached to the cardboard application table 11, respectively. Each of the first to fourth guides 12 to 24 protrudes at a length which is smaller than a thickness of the first to third cardboards 26*a* to 26*c*. Since the first to third cardboards 26*a* to 26*c* of various dimensions are used according to a dimension of the hardback book cover to be formed, the second to fourth guides 13 to 24 can slide in a lateral direction of the cardboard application table 11 according to the various dimensions of the cardboards.

The cardboard attachment section 1 farther comprises a pressing roller 25 arranged opposite to a top face of the cardboard application table 11 at a predetermined interval and extends in parallel to the first guide 12. A gap between the cardboard application table 11 and the pressing roller 25 is set in such a manner as to become a little larger than a height of the first to fourth guides 13 to 24.

The pressing roller 25 is translated in the direction normal to the first guide 12 above the cardboard application table 11. The first to third cardboards 26*a* to 26*c* are attached to the rear face of the cover 27 by the pressing roller 12 during the movement of the pressing roller 25.

Figure 5:
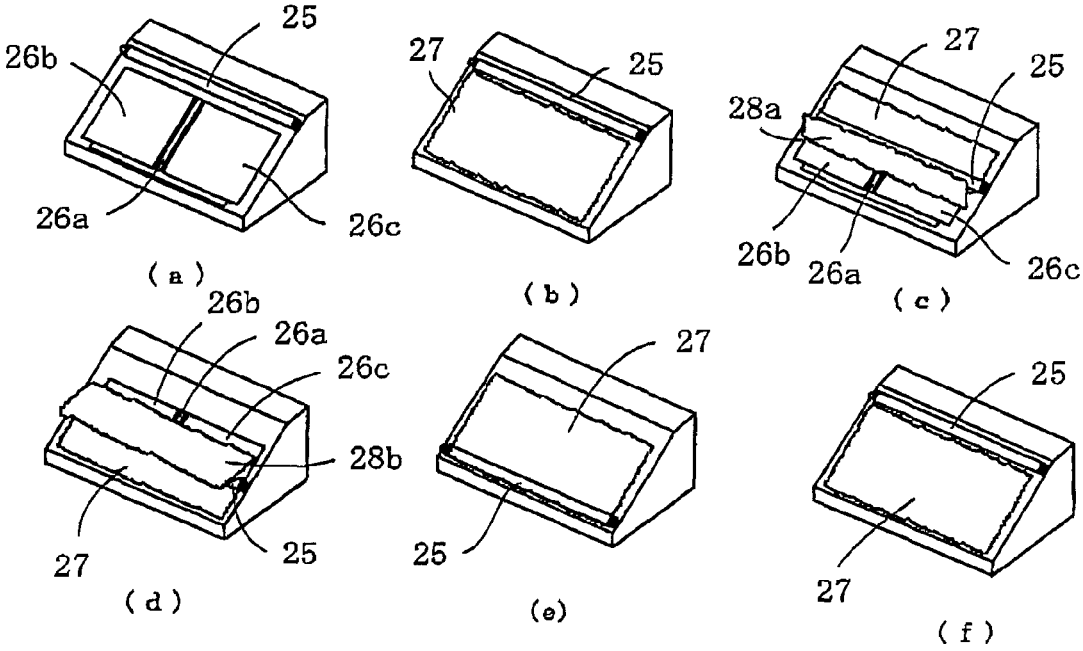
FIGS. 5 (*a*), 5 (*b*), 5 (*c*), 5 (*d*), 5 (*e*) and 5 (*f*) are successive perspective views illustrating an operation of a cover attachment section.
Figure 6:
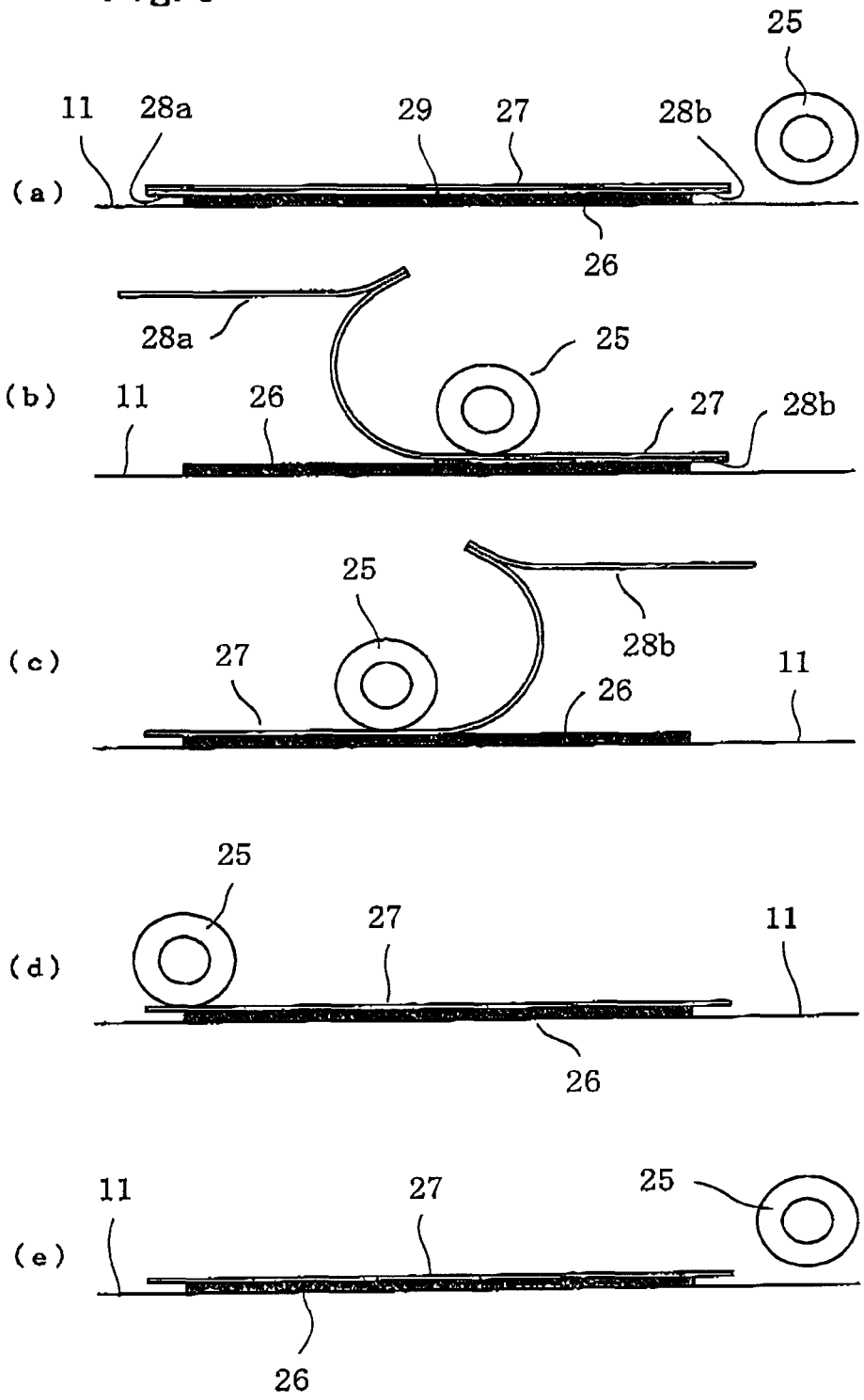
FIGS. 6 (*a*), 6 (*b*), 6 (*c*), 6 (*d*) and 6 (*e*) are side sectional views corresponding to FIGS. 5 (*a*), 5 (*b*), 5 (*c*), 5 (*d*) and 5 (*e*)

The attachment of the first to third cardboards 26*a* to 26*c* to the cover 27 by the pressing roller 25 will be explained. FIG. 5 is a perspective view illustrating an operation of a cover attachment section and FIG. 6 is a side elevational view corresponding to FIGS. 5B to 5F. In FIG. 6, the reference numeral 26 represents the first to third cardboards 26*a* and 26*c*. As shown in FIGS. 5 and 6, in this embodiment, the cover 27 has an adhesive layer (not shown) on a rear face thereof, and release papers 28*a* and 28*b* overlapping the adhesive layer, and a cut line 29 between the release papers 28*a* and 28*b* extends in a lateral direction (a direction normal to a direction connecting the top and bottom edges the hardback book cover).

Figure 14:
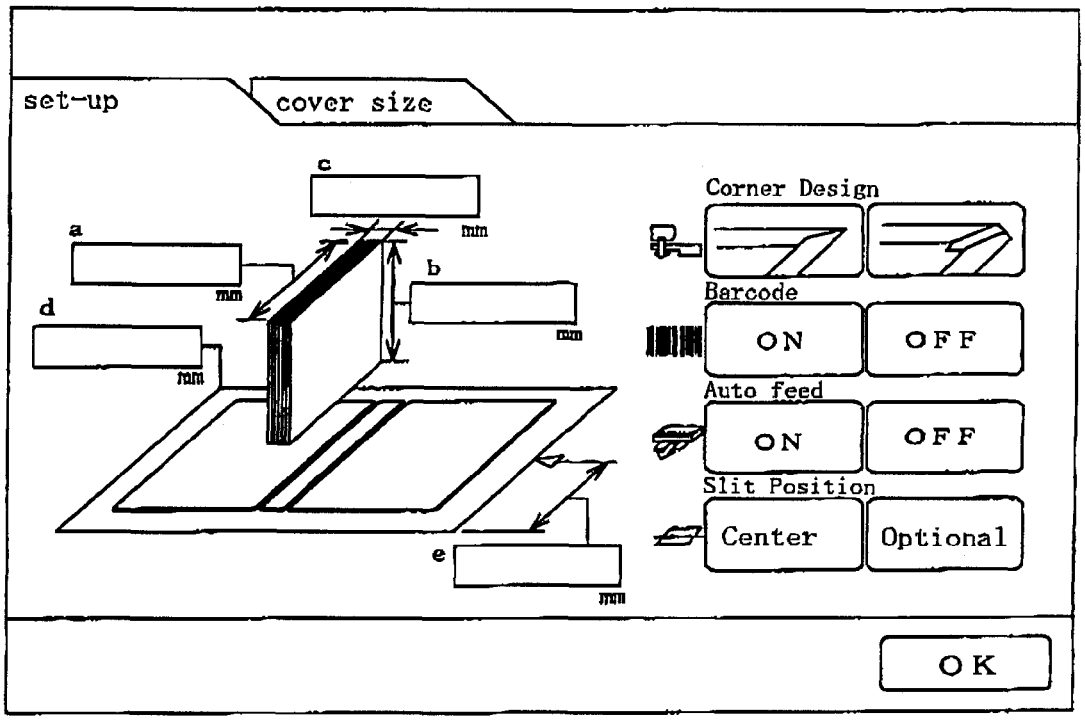
FIG. 14 is a plan view illustrating one of screen pages displayed on an operation panel.
Figure 15:
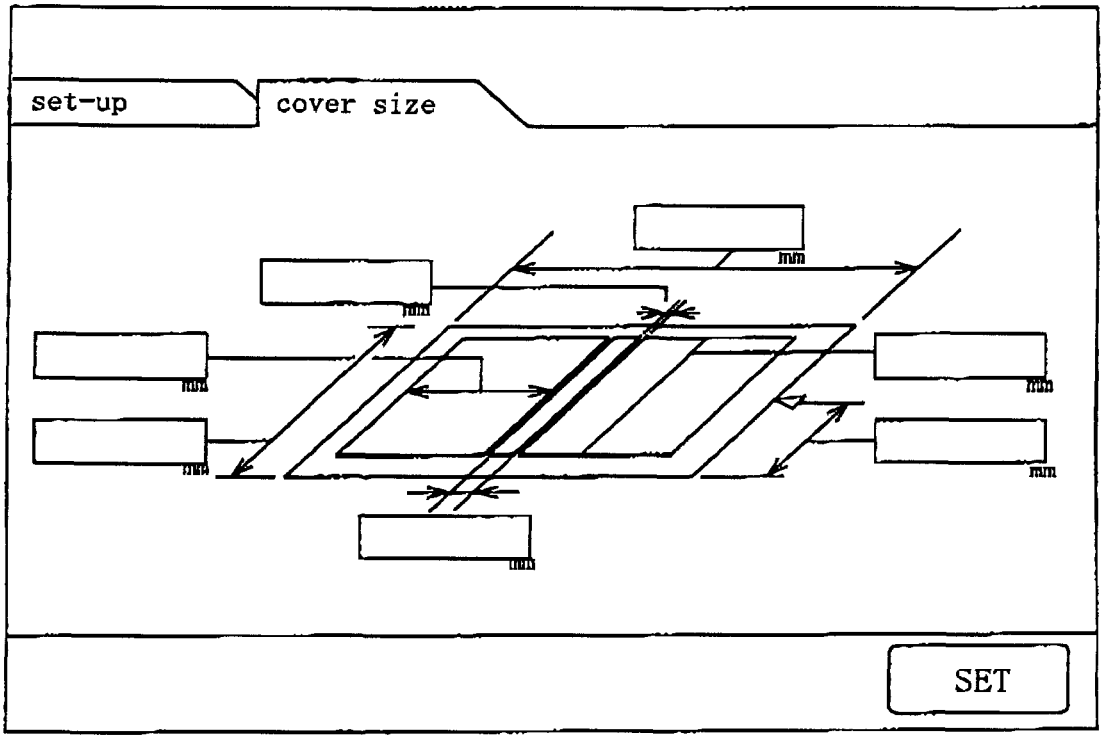
FIG. 15 is a plan view illustrating one of screen pages displayed on the operation panel.
Figure 16:
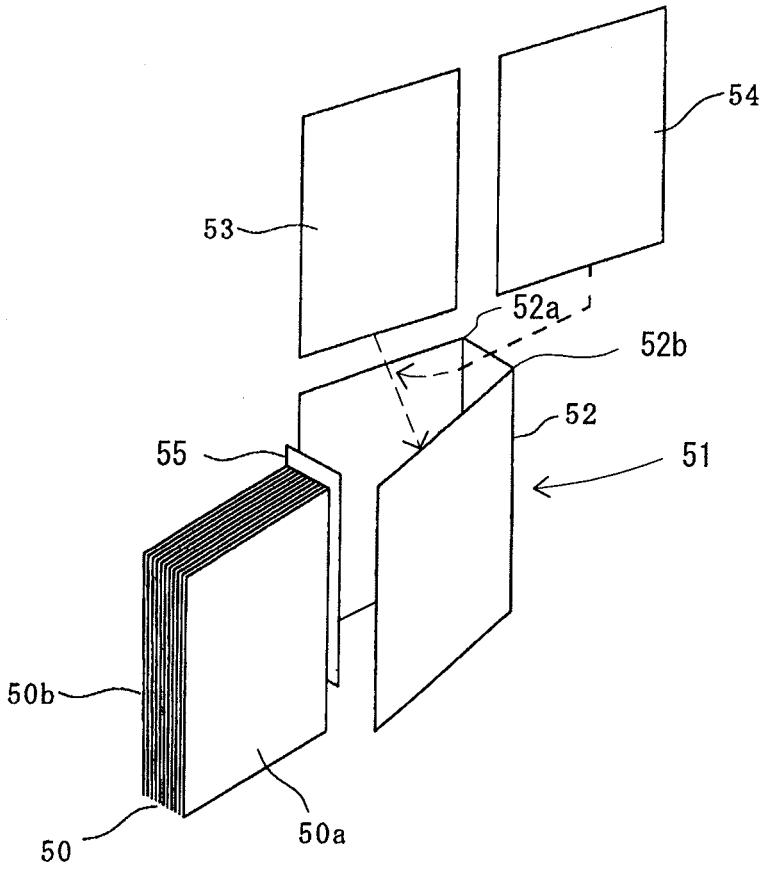
FIG. 16 is an exploded perspective view of a hardback book manufactured by a simple hardback bookbinding.

First of all, necessary data is input from the operation panel 4 prior to the attaching operation by the cover attachment section 1. Each of FIGS. 14 and 15 is a plan view illustrating one of screen pages displayed on an operation panel. In the screen page shown in FIG. 14, the data of a length (a), a width (b) and a thickness (c) of the book block can be input in mm unit, and the data of a width of chamfer (d) of the cover 27 and a distance (e) of the cut line 29 of the release papers 28*a* and 28*b* of the cover 27 from a lower end of the book cover can be input in mm unit.

When an "OK" button in a lower right area of the screen page is pushed after the necessary data is input through the screen page shown in FIG. 14, the control section 7 calculates the dimensions of the necessary cardboards 26*a* to 26*c* and the dimension of the cover 27 based on the input data, and displays the screen page for confirmation of the input data on the operation panel 4 as shown in FIG. 15. This screen page indicates the length and the width of the first to third cardboards 26*a* to 26*c*, the length and the width of the cover 27, and the distance of the cut line 29 of the release papers 28*a*, 28*b* from the lower end of the cover 27. The first to third cardboards 26*a* to 26*c* and the cover 27 which have the dimensions indicated on the screen page are prepared by an operator. Thereafter, when a "SET" button in a lower right portion of the screen page for confirmation is pushed, the control section 7 adjusts the positions of the second to fourth guides 13 to 24 of the cardboard attachment section 1 in such a manner as to adapt to the dimensions of the designated cardboards 26*a* to 26*c*, and turns on the alignment lamp 6.

As shown in FIG. 5A, the pressing roller 25 is positioned at an upper end of the cardboard application table 11, the first to third cardboards 26*a* to 26*c* are arranged at the predetermined positions on the cardboard application table 11, and the cover 27 is put thereon in such a manner that the center of the cover 27 comes into line with the position indicated by the alignment lamp 6 and that the front face of the cover 27 faces upward, as shown in FIGS. 5B and 6A.

A start button 1*a* of the cardboard attachment section 1 is pressed, and the pressing roller 25 is moved downward and stops at a position just above the cut line 29 of the release papers of the cover 27, as shown in FIGS. 5C and 6B. At this position, the lower release paper 28*a* is separated from the cover 27, and a lower portion of the cover 27 is put on the first to third cardboards 26*a* to 26*c* via the adhesive layer. The start button 1*a* is pressed, and the pressing roller 25 is moved to a position just below a lower end edge of the upper release paper 28*b* so as to stop, as shown in FIGS. 5D and 6C. At this position, the upper release paper 28*b* is separated from the cover 27, and the upper portion of the cover 27 is put on the first to third cardboards 26*a* to 26*c* via the adhesive layer.

Then the start button 1*a* is pressed, and the pressing roller 25 is moved to lower end edges of the first to third cardboards 26*a* to 26*c*, as shown in FIGS. 5E to 6D, thereby the lower portion of the cover 27 is attached to the first to third cardboards 26*a* to 26*c*. Further, as shown in FIGS. 5F to 6E, the pressing roller 25 is moved to an upper end of the cardboard application table 11, thereby the upper portion of the cover 27 is attached to the first to third cardboards 26*a* to 26*c*.

Accordingly, the first cardboard 26*a* forming the spine, the second cardboard 26*b* forming the front cover, and the third cardboard 26*c* forming the rear cover are attached to the predetermined positions on the rear face of the cover 27 by the cardboard attachment section 1, and an outer margin 27*a* of a predetermined width with the adhesive layer is formed outside each of the cardboards (see FIG. 4).

Figure 7:
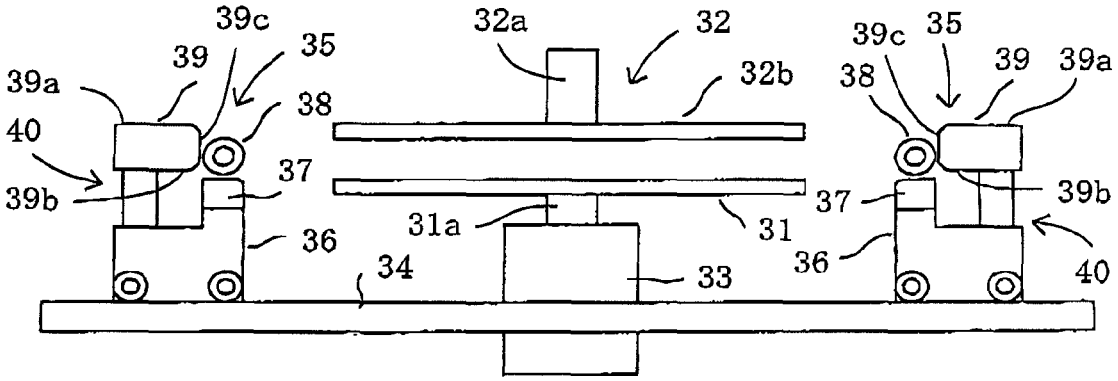
FIG. 7 is a side elevational view illustrating a structure of a cover forming section.
Figure 8:
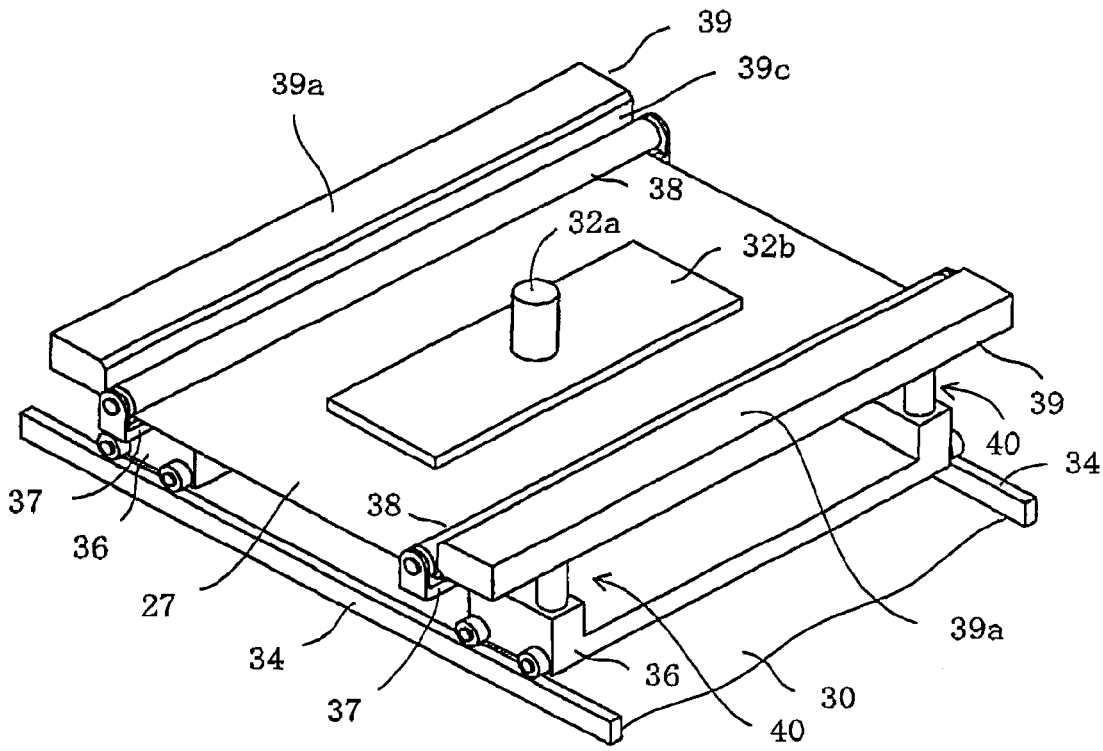
FIG. 8 is a perspective view of a cover forming section located in an outer margin folding position for folding an outer margin corresponding to top and bottom edges of a hardback book cover.
Figure 9:
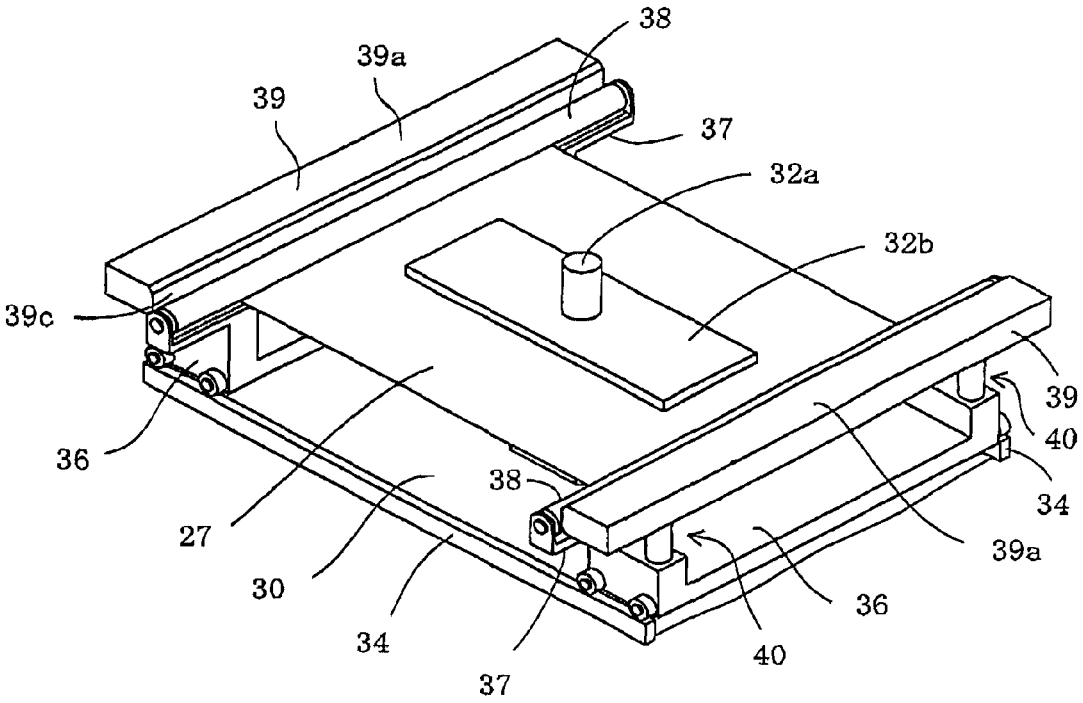
FIG. 9 is a perspective view of the cover forming section located in an outer margin folding position for folding an outer margin corresponding to front edges of a hardback book cover.
Figure 10:
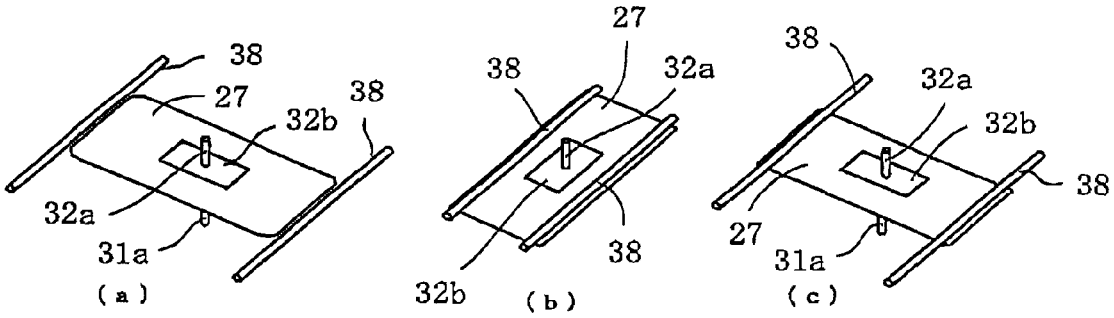
FIGS. 10(*a*), 10(*b*) and 10(*c*) are views illustrating a positional relationship between a table and a folding unit when the cover forming section operates.

FIG. 7 is a side elevational view illustrating a structure of the cover forming section, FIG. 8 is a perspective view of the cover forming section located in an outer margin folding position for folding the outer margin corresponding to the top and bottom edges of the hardback book cover, and FIG. 9 is a perspective view of the cover forming section located in an outer margin folding position for folding the outer margin corresponding to the front edges of the hardback book cover. FIG. 10 is a view illustrating a positional relationship between the table and the folding unit when the cover forming section operates. In FIG. 10, the folding unit is pictured by only a guide roller which is a constituent element of the folding unit.

Referring to FIGS. 7 to 9, the cover forming section 2 comprises a table 31 provided with a rotating shaft 31*a* which extends downward from the underside of the table 31, and attached to the frame 30 for rotating around the rotating shaft 31*a* so as to be located in at least two positions of a first position (see FIG. 8) and a second position (see FIG. 9) which is rotated at 90 degrees from the first position in a clockwise or counterclockwise direction. The cover with cardboards, which is processed in the cardboard attachment section 1, is arranged on the table 31 in such a manner that the center of the cover is aligned with the rotating shaft 31*a*. The rotating shaft 31*a* of the table 31 is driven by a motor 33.

The cover forming section 2 comprises a fixing means 32 which is arranged at the frame 30 or the table 31, fixes the cover 27 to the table 31, and rotates the cover 27 together with the table 31. In this embodiment, the fixing means 32 comprises a rod 32*a* attached to the frame 30, and arranged above the table 31 for reciprocal vertical movement along an extension of the rotating shaft 31*a* of the table 31, a drive unit (not shown) attached to the frame 30 for actuating the rod 32*a*, and a pressing plate 32*b* attached to the lower end of the rod 32*a* for rotation around the axis of the rod 32*a*.

The cover forming section 2 further comprises guide rails 34 attached to the frame 30 and linearly extending on either side of the table 31, and a pair of folding units 35 arranged on either side of the table 31 and guided by the guide rails 34 for reciprocal linear movement in directions toward and away from the table 31 in such a manner that the folding units 35 are located in two positions of an outer margin folding position (see FIGS. 10B and 10C) at which the folding units 35 engage with the cover 27 on the table 31 for folding the outer margin 27*a* so as to attach the outer margin 27*a* to the associated cardboards 26*a* to 26*c*, and an standby position (see FIG. 10A) at which the folding units 35 separate from the cover 27.

The cover 27 on the table 31 is arranged to face a pair of opposite sides thereof toward the associated folding units 35 when the table 31 is located in the first position.

The motor 33 and a pair of the folding units 35 are controlled by the control unit 7. The control unit 7 transmits a control signal to the motor 33 and a pair of the folding units 35 for synchronization of a pair of the folding units 35 in such a manner that the folding units 35 simultaneously fold the outer margin 27*a* of the cover 27 each time the table 31 is located in the first and second positions.

The folding unit 35 comprises a moving body 36 guided by the guide rails 34 for the reciprocal linear movement, a horizontal support plate 37 attached to the moving body 36 and extending perpendicularly to the movement direction of the moving body 36, and a guide roller 38 attached to the support plate 37 and arranged opposite to the top face of the support plate 37 for rotation around a rotating shaft 31*a* extending in a longitudinal direction of the support plate 37. In this case, the guide roller 38 may be attached to the moving body 36.

When the folding unit 35 is located in the outer margin folding position, the movement of the moving body 36 effects a movement of the support plate 37 and the guide roller 38 on the front faces of the cover 27 and the cardboards 26*a* to 26*c* while the cover 27 and the cardboards 26*a* to 26*c* being nipped between the support plate 37 and the guide roller 38.

The cover folding unit 35 also comprises a folding block 39 attached to the moving body 36 and extending in parallel to the support plate 37. The folding block 39 is arranged at a side of the support plate 37 for reciprocal vertical movement between a top dead center and a bottom dead center, the side of the support plate 37 faces away from the table 31.

The cover folding unit 35 further comprises a drive unit 40 attached to the moving body 36 for moving the folding block 39.

Figure 11:
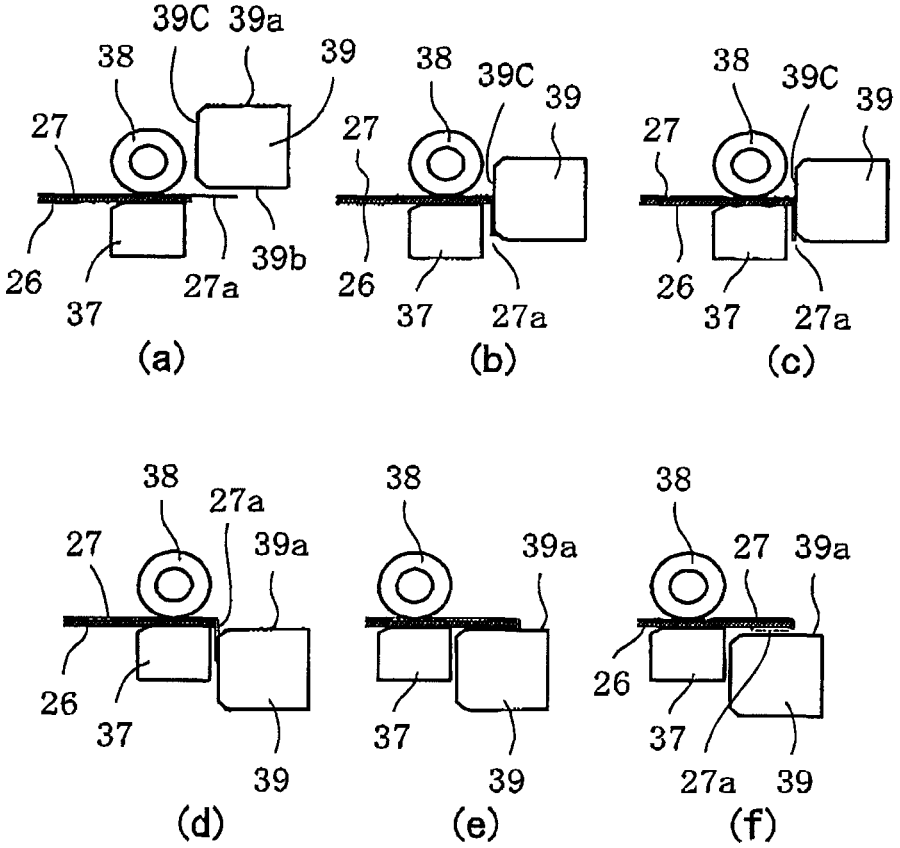
FIGS. 11(*a*), 11(*b*), 11(*c*), 11(*d*), 11(*e*) and 11(*f*) are views sequentially illustrating an operation of a folding unit located in an outer margin folding position.

FIG. 11 is a view illustrating an operation of the folding unit located in the outer margin folding position. Referring to FIG. 11, the folding block 39 has a horizontal upper face 39*a*, a lower face 39*b*, and a vertical front face 39*c* facing to the table. When the folding unit 35 is located in the outer margin folding position, the folding block 39 is located sequentially in four positions of the top dead center (see FIG. 11A) at which the lower face 39*b* of the folding block 39 is positioned above the top face of the cover 27, a first intermediate position (see FIGS. 11B and 11C) at which the front face 39*c* of the folding block 39 faces to a gap between the support plate 37 and the guide roller 38, a second intermediate position (see FIGS. 11D and 11E) at which the top face 39*a* of the folding block 39 is positioned at the same height as the top face of the support plate 37, and a bottom dead center at which the top face 39*a* of the folding block 39 is positioned below the top face of the support plate 37.

The control unit 7 transmits the control signal to the moving body 36 of the folding unit 35 and the drive unit 40 for interlocking the moving body 36 and the folding block 39 so as to fold the outer margin 27*a* of the cover 27 when the folding unit 35 is located in the outer margin folding position. The interlocking of the moving body 36 and the folding block 39 is carried out as follows.

(i) The folding block 39 is arranged at the top dead center and the moving body 36 moves toward the table 31.

(ii) The moving body 36 stops at a first stop position (refer to FIG. 11A) at which the cover 27 and the cardboard 26 are nipped between the support plate 37 and the guide roller 38, and the edge of the cardboard 26 is positioned between a side of the support plate 37 and the front face 39*c* of the folding block 39, the side of the support plate 37 facing away from the table 31.

(iii) The folding block 39 moves downward from the top dead center to the first intermediate position (see FIG. 11B) at the first stop position, thereby folding the outer margin 27*a* of the cover 27 toward the cardboard 26.

(iv) The moving body 36 moves in a direction toward the table 31 from the first stop position to a second stop position (see FIG. 11C) at which the front face 39*c* of the folding block 39 comes into contact with an edge of the cardboard 26.

(v) The folding block 39 moves downward from the first immediate position to the second intermediate position (see FIG. 11D) at the second stop position, and the moving body 36 moves in a direction toward the table 31 from the second stop position to a third stop position (see FIG. 11E) at which the front end edge of the top face 39*a* of the folding block 39 reaches to at least a leading end of the outer margin 27*a*, thereby pressing the outer margin 27*a* against the cardboard 26 by the top face 39*a* of the folding block 39*a* so as to attach the outer margin 27*a* to the cardboard 26.

(vi) The folding block 39 moves downward from the second intermediate position to the bottom dead center (see FIG. 11F) at the third stop position so as to separate the folding block 39 from the cardboard 26, and the moving body 36 moves in a direction away from the table 31 to a fourth stop position at which the cover 27 and the cardboard 26 get out of the gap between the support plate 37 and the guide roller 38.

As mentioned above, according to the present invention, since the cover with the cardboards is arranged on the table, and fixed so as to be rotatable together with the table, a pair of folding units are arranged on either side of the table for reciprocal linear movement in the direction toward and away from the table, the table is rotated between the first position at which one pair of opposite sides of the cover face to the folding units, and the second position at which the other pair of opposite sides of the cover faces to the folding units, and the outer margin of the cover facing to the folding units are simultaneously folded by synchronization of the folding units when the table is located in the first and second positions, easy and quick formation of a hardback book cover is achieved.

Figure 12:
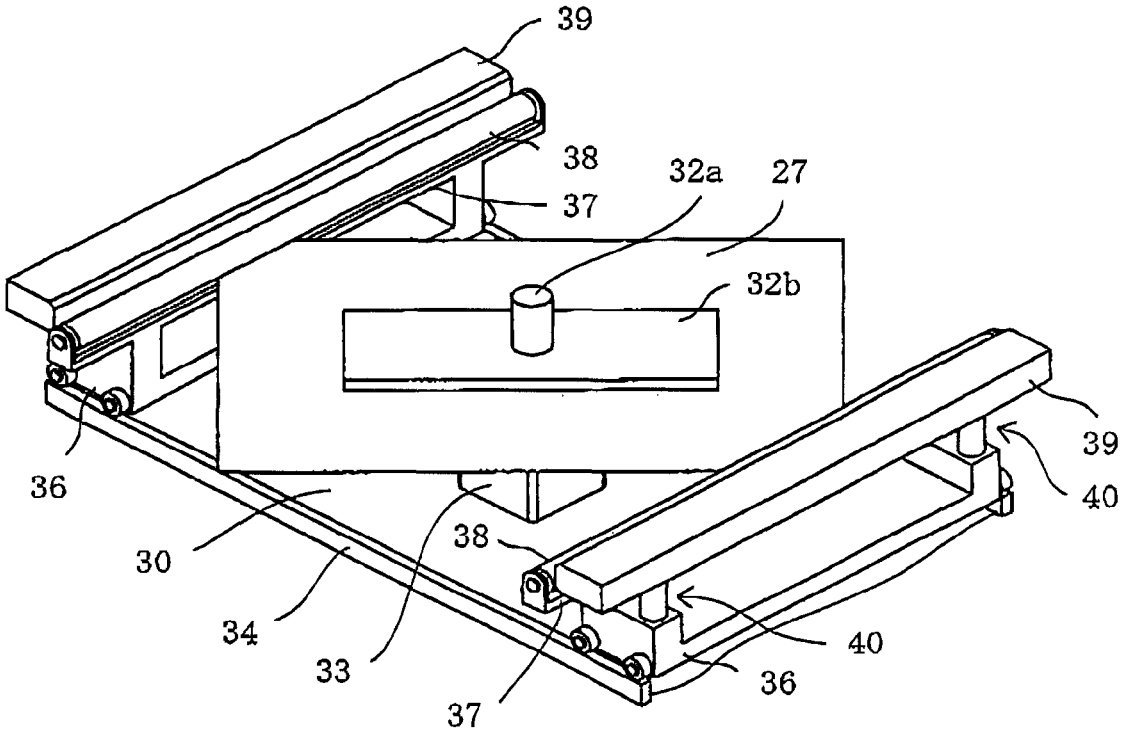
FIG. 12 is a perspective view illustrating a structure of a cover forming section according to another embodiment of the present invention.
Figure 13:
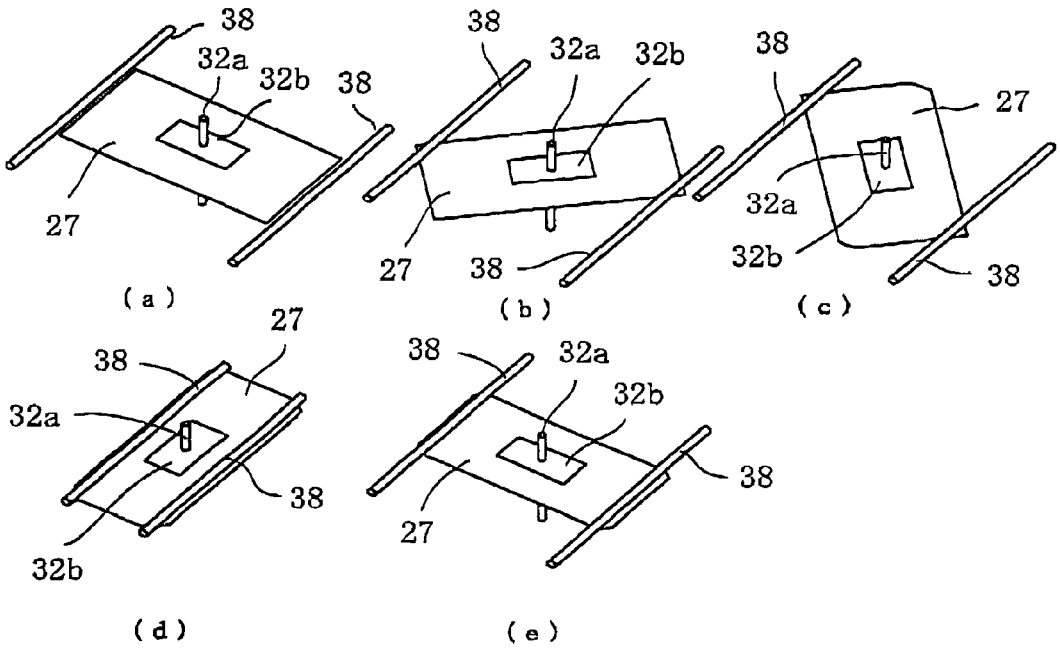
FIGS. 13(*a*), 13(*b*), 13(*c*), 13(*d*), and 13(*e*) are views sequentially illustrating a positional relationship between a table and a folding unit when the cover forming section shown in FIG. 12 forms a hardback book cover.

FIG. 12 is a perspective view illustrating a structure of a cover forming section according to another embodiment of the present invention, and FIG. 13 is a view illustrating a positional relationship between a table and a folding unit when the cover forming section shown in FIG. 12 forms a hardback book cover. In FIG. 12, the folding unit is pictured by only a guide roller of a constituent element of the folding unit.

Referring to FIGS. 12 and 13, this embodiment is suitable for forming a hardback book cover whose corners are cut at 45 degrees. In this embodiment, the rotating table 31 is located in third and fourth rotating positions (see FIGS. 13B and 13C) which are rotated at 45 degrees from the first position in clockwise and counterclockwise directions, in addition to the first position (see FIG. 13D), and the second position (see FIG. 13E) rotated at 90 degrees from the first position in a clockwise or counterclockwise direction. In this case, although an illustration is omitted, the corresponding corners of the cardboard attached to the cover 27 (the corners of the second cardboard forming the front cover and the third cardboard forming the rear cover) are cut at 45 degrees.

A pair of folding units 35 is located in two positions of the outer margin folding position (see FIGS. 13B to 13E) at which the folding units 35 engage with the cover 27 on the table 31 and fold the outer margin so as to attach the outer margin to the associated cardboards 26*a* to 26*c*, and the standby position (see FIG. 13A) at which the folding units 35 separate from the cover 27.

The control unit 7 transmits the control signal to the motor 33 and the folding unit 35, synchronously moves a pair of folding units 35 when the table 31 is located in the first, second, third and fourth positions, and simultaneously folds the outer margins 27*a* of the cover 27 facing to a pair of folding units 35. Accordingly, there is formed the hardback book cover whose corners are cut at 45 degrees.

The hardback book cover formed by the cover forming section 2 is combined with the book block after confirming that the hardback book cover coincides with the hardback book cover by means of the barcode reader 5. The adhesive layer and the release paper overlapping the adhesive layer are provided in the front side and rear side end leaf papers of the book block, and a thermoplastic adhesive agent is applied to the spine of the book block. The book block and the hardback book cover are combined so that the first cardboard (the cardboard forming the spine) in the rear face of the hardback book cover is lapped over the spine of the book block, and they are inserted to the cover attachment section 3 in such a manner that the spine of the hardback book cover faces downward. When the start button 3*a* of the cover attachment section 3 is pressed, a press unit (not shown) having a heater of in provided in the cover attachment section 3 is actuated, and the hardback book cover is attached to the spine of the book block. Thereafter, the combination of the book block and the hardback book cover is taken out of the cover attachment section 3, the release papers of the front side of the book block and the rear side end leaf paper are stripped, and the second cardboard (the cardboard forming the front cover) of the rear face of the hardback book cover and the third cardboard (the cardboard forming the rear cover) are attached to the end leaf papers, thereby the hardback book is manufactured.

In this embodiment, the apparatus for forming the hardback book cover according to the present invention is incorporated into the book binding apparatus, and functions the cover forming section of the book binding apparatus, however, the present invention may be realized as an apparatus for forming the hardback book cover.

The invention claimed is:

1. An apparatus for forming a hardback book cover, comprising:

a frame (30);

a rotary table (31) for supporting a generally rectangular cover sheet (27) having a rear face attached to a plurality of stiffening boards (26*a*, 26*b*, 26*c*) lying in a plane underneath the cover sheet (27);

a fixing unit (32) for pressing the cover sheet (27) against the stiffening boards (26*a*, 26*b*, 26*c*), with the cover sheet (27) having a first pair of opposite, top and bottom, outer margins (27*a*) having an adhesive layer on the rear face of the cover sheet (27) and extending beyond the stiffening boards (26*a*, 26*b*, 26*c*), and a second pair of opposite, front and rear, outer margins (27*a*) having an adhesive layer on the rear face of the cover sheet (27) and extending beyond the stiffening boards (26*a*, 26*b*, 26*c*);

a drive (33) for jointly turning the table (31) and the fixing unit (32), together with the cover sheet (27) and the attached stiffening boards (26*a*, 26*b*, 26*c*), relative to the frame (30) about an upright axis between first and second cover positions that are angularly offset by 90°;

a pair of horizontal linear guide rails (34) mounted on the frame (30) at opposite sides of the upright axis;

a pair of folding units (35) mounted at opposite sides, and extending widthwise, of the rotary, table (31) for reciprocal linear movement on and along the guide rails (34) simultaneously toward each other in a folding position, and simultaneously away from each other in a standby position; and a control unit (7) for controlling the drive (33) to successively turn the cover sheet (27) to the first and second cover positions, and to move the folding units (35) in synchronism with the drive (33) to the folding position in which the folding units (35) simultaneously engage, fold and adhere the top and bottom outer margins (27*a*) to the stiffening boards in one of the cover positions, and simultaneously engage, fold and adhere the front and rear outer margins (27*a*) to the stiffening boards in the other of the cover positions.

2. The apparatus according to claim 1, wherein the table (31) is supported by a table shaft (31*a*), and wherein the fixing unit (32) is supported by a fixing shaft (32*a*) which is collinear with the table shaft (31*a*) along the axis, and wherein the drive (33) is a motor.

3. The apparatus according to claim 1, wherein each folding unit (35) includes a moving body (36), a support member (37) mounted on the moving body (36), a guide roller (38) mounted on one of the moving body (36) and the support member (37) and spaced from the support member (37) to form a gap in which the cover sheet (27) and one of the stiffening boards is nipped in the folding position, a folding block (39) mounted on the moving body (36) for reciprocal vertical movement, and a driving unit (40) for vertically moving the folding block (39) between a top dead center position in which the folding block (39) is located above a respective outer margin (27*a*) and a bottom dead center position in which the folding block (39) is located below the respective outer margin (27*a*).

4. The apparatus according to claim 3, wherein the folding block (39) has a horizontal top face (39*a*), a horizontal lower face (39*b*), and a vertical front face (39*c*) facing the table (31), wherein the lower face (39*b*) of the folding block (39) is positioned above the cover sheet (27) in the top dead center position, and wherein the top face (39*a*) of the folding block (39) is positioned below a top face of the support member (37) in the bottom dead center position.

5. The apparatus according to claim 4, wherein the driving unit (40) is operative for sequentially moving the folding block (39) from the top dead center position to a first intermediate position and a second intermediate position before reaching the bottom dead center position, wherein the front face (39*c*) of the folding block (39) faces the gap between the support member (37) and the guide roller (38) in the first intermediate position, wherein the top face (39*a*) of the folding block (39) is positioned at the same height as the top face of the support member (37) in the second intermediate position.

6. The apparatus according to claim 5, wherein the control unit (7) stops the moving body (36) at a first stop position at which the cover sheet (27) and the stiffener boards (26*a* to 26*c*) are nipped between the support member (37) and the guide roller (38), and an edge of stiffener boards (26*a* to 26*c*) is positioned between a side of said support member (37) and the front face (39*c*) of the folding block (39); and wherein the driving unit (40) is operative for moving the folding block (39) downward from the top dead center position to the first intermediate position at the first stop position, thereby folding the respective outer margin (27*a*) of the cover sheet (27) toward the stiffener boards (26*a* to 26*c*).

7. The apparatus according to claim 6, wherein the control unit (7) moves the moving body (36) from the first stop position to a second stop position in a direction toward the table (31) until the front face (39*c*) of the folding block (39) comes into contact with the edge of the stiffener boards (26*a* to 26*c*), thereby attaching the respective outer margin (27*a*) to the edge of the stiffener boards (26*a* to 26*c*); wherein the driving unit (40) is operative for moving the folding block (39) downward from the first intermediate position to the second intermediate position at the second stop position; and wherein the control unit (7) moves the moving body (36) in a direction toward the table (31) from the second stop position to a third stop position at which a front end of the top face (39*a*) of the folding block (39) reaches to at least a leading end of the respective outer margin (27*a*), thereby pressing the respective outer margin (27*a*) against the stiffener boards (26*a* to 26*c*) by the top face (39*a*) of the folding block (39) so as to attach the respective outer margin (27*a*) to the stiffener boards (26*a* to 26*c*); and wherein the driving unit (40) is operative for moving the folding block (39) downward from the second intermediate position to the bottom dead center position at the third stop position so as to separate the folding block (39) from the stiffener boards (26*a* to 26*c*), and wherein the control unit (7) is operative for moving the moving body (36) in a direction away from the table (31) to a fourth stop position at which the cover sheet (27) and the stiffener boards (26*a* to 26*c*) leave the gap between the support member (37) and the guide roller (38).

8. The apparatus according to claim 1, wherein opposite ones of the attached stiffening boards have corners cut at 45°; and wherein the drive (33) is operative for jointly turning the table (31) and the fixing unit (32), together with the cover sheet (27) and the attached cut stiffening boards (26*a*, 26*b*, 26*c*), relative to the frame (30) about the upright axis between third and fourth cover positions that are angularly offset by 45° from the first and second cover positions; and wherein the control unit (7) is also operative for controlling the drive (33) to successively turn the cover sheet (27) to the third and fourth cover positions, and to move the folding units (35) in synchronism with the drive (33) to the folding position in which the folding units (35) simultaneously engage, fold and adhere a first pair of opposite outer corner margins (27*a*) to the stiffening boards in the third cover position, and simultaneously engage, fold and adhere a second pair of opposite outer corner margins (27*a*) to the stiffening boards in the fourth cover position.

9. An apparatus for forming a hardback book cover, comprising:

a frame (30); a rotary table (31) for supporting a generally rectangular cover sheet (27) having a rear face attached to a plurality of stiffening boards (26*a*, 26*b*, 26*c*) lying in a plane underneath the cover sheet (27);

a fixing unit (32) for pressing the cover sheet (27) against the stiffening boards (26*a*, 26*b*, 26*c*), with the cover sheet (27) having a first pair of opposite, top and bottom, outer margins (27*a*) having an adhesive layer on the rear face of the cover sheet (27) and extending beyond the stiffening boards (26*a*, 26*b*, 26*c*), and a second pair of opposite, front and rear, outer margins (27*a*) having an adhesive layer on the rear face of the cover sheet (27) and extending beyond the stiffening boards (26*a*, 26*b*, 26*c*);

a drive (33) for jointly turning the table (31) and the fixing unit (32), together with the cover sheet (27) and the attached stiffening boards (26*a*, 26*b*, 26*c*), relative to the frame (30) about an upright axis between first and second cover positions that are angularly offset by 90°;

a pair of horizontal linear guide rails (34) mounted on the frame (30) at opposite sides of the upright axis;

a pair of folding units (35) mounted at opposite sides, and extending widthwise, of the rotary table (31) for reciprocal linear movement on and along the guide rails (34) simultaneously toward each other in a folding position, and simultaneously away from each other in a standby position; and a control unit (7) for controlling the drive (33) to successively turn the cover sheet (27) to the first and second cover positions, and to move the folding units (35) in synchronism with the drive (33) to the folding position in which the folding units (35) simultaneously engage, fold and adhere the top and bottom outer margins (27*a*) to the stiffening boards in one of the cover positions, and simultaneously engage, fold and adhere the front and rear outer margins (27*a*) to the stiffening boards in the other of the cover positions, wherein each folding unit (35) includes a moving body (36), a support member (37) mounted on the moving body (36), a guide roller (38) mounted on one of the moving body (36) and the support member (37) and spaced from the support member (37) to form a gap in which the cover sheet (27) and one of the stiffening boards is nipped in the folding position, a folding block (39) mounted on the moving body (36) for reciprocal vertical movement, and a driving unit (40) for vertically moving the folding block (39) between a top dead center position in which the folding block (39) is located above a respective outer margin (27*a*) and a bottom dead center position in which the folding block (39) is located below the respective outer margin (27*a*);

wherein the folding block (39) has a horizontal top face (39*a*), a horizontal lower face (39*b*), and a vertical front face (39*c*) facing the table (31), wherein the lower face (39*b*) of the folding block (39) is positioned above the cover sheet (27) in the top dead center position, and wherein the top face (39*a*) of the folding block (39) is positioned below a top face of the support member (37) in the bottom dead center position;

wherein the driving unit (40) is operative for sequentially moving the folding block (39) from the top dead center position to a first intermediate position and a second intermediate position before reaching the bottom dead center position, wherein the front face (39*c*) of the folding block (39) faces the gap between the support member (37) and the guide roller (38) in the first intermediate position, wherein the top face (39*a*) of the folding block (39) is positioned at the same height as the top face of the support member (37) in the second intermediate position; and wherein the control unit (7) stops the moving body (36) at a first stop position at which the cover sheet (27) and the stiffener boards (26*a* to 26*c*) are nipped between the support member (37) and the guide roller (38), and an edge of stiffener boards (26*a* to 26*c*) is positioned between a side of said support member (37) and the front face (39*c*) of the folding block (39); and wherein the driving unit (40) is operative for moving the folding block (39) downward from the top dead center position to the first intermediate position at the first stop position, thereby folding the respective outer margin (27*a*) of the cover sheet (27) toward the stiffener boards (26*a* to 26*c*).

* * * * *